US005431027A

United States Patent [19]

Carpenter

[11] Patent Number: 5,431,027

[45] Date of Patent: Jul. 11, 1995

[54] FLAKE ICE-MAKING APPARATUS

[75] Inventor: Walter H. Carpenter, Riverview, Fla.

[73] Assignee: Henry Vogt Machine Co., Louisville, Ky.

[21] Appl. No.: 856,381

[22] Filed: Mar. 23, 1992

[51] Int. Cl.[6] ..... F25C 1/14

[52] U.S. Cl. ..... 62/354; 15/246; 15/246.5; 165/154

[58] Field of Search ..... 62/354, 524, 525; 165/154; 15/246, 246.5; 239/565

[56] References Cited

U.S. PATENT DOCUMENTS

| | | | |
|---|---|---|---|
| 2,683,357 | 7/1954 | Albright | 62/354 |
| 2,758,451 | 8/1956 | Lauterbach | 62/354 |
| 2,812,644 | 11/1957 | Newman | 62/354 X |
| 2,910,841 | 11/1959 | Branchflower | 62/354 X |
| 2,986,902 | 6/1961 | Michener et al. | 62/354 X |
| 3,120,743 | 2/1964 | Wilson | 62/525 X |
| 3,206,945 | 9/1965 | Nilsson et al. | 62/352 |
| 3,888,647 | 6/1975 | Breeden et al. | 165/154 X |
| 4,075,868 | 2/1978 | Bartholmey | 62/354 X |

*Primary Examiner*—William E. Tapolcal

[57] ABSTRACT

A flake ice-making apparatus includes a cylindrical refrigerant evaporator having a cylindrical evaporator chamber surrounding a cylindrical ice-forming bore surface. A water-flow distributor for introducing water to be frozen against the ice-forming bore surface is located at the top end of the cylindrical refrigerant evaporator so that the water flows downwardly in a thin sheet over the ice-forming bore surface and is frozen on the ice-forming bore surface. An elongated ice-scraping blade is located at the ice-forming bore surface. An ice-scraping blade moving device moves the ice-scraping blade in a rotary motion over the ice-forming bore surface to remove the ice from the ice-forming bore surface and to form ice flakes.

12 Claims, 6 Drawing Sheets

FLAKE ICE-MAKING APPARATUS

BACKGROUND OF THE INVENTION

The present invention relates to ice-making machines, and more particularly to an apparatus for making flakes of ice especially suited for making flakes of ice from salt water.

Ice-making machines for making flakes of ice are, per se, known. Further, flake ice-making machines for making flakes of ice from salt water are also, per se, known.

Flake ice machines have numerous industrial applications. For example, a typical industrial application for flake ice-making machines for making flakes of ice (or flaked ice) from salt water is in the fishing industry. Such flake ice-making machines are installed on commercial fishing boats to make flaked ice of sea water for refrigerating the fish catch in the holding tanks of the fishing boat.

There are numerous drawbacks with the heretofore known flake ice-making machines. For example, in the known flake ice-making machines having cylindrical refrigerant evaporators, the cylindrical evaporators are fabricated of a continuously spiraled or coiled refrigerant conduit with adjacent turns of the coiled conduit in contact and continuously welded together. The cylindrical bore surface of the coiled conduit must be machined to a smooth surface to provide a cylindrical ice-forming surface. This construction is very expensive to manufacture and is prone to defects.

Further, the spiraled or continuously-coiled refrigerant conduit of the cylindrical evaporator defines a very long refrigerant flow path through the evaporator.

Another drawback with the heretofore known flake ice-making machines is that the operation of the water distributor devices for supplying water to be frozen to the cylindrical evaporator is adversely effected by a change in orientation experienced by a tilting of the ice-making machine. This drawback is particularly troublesome when the flake ice-making machine is installed on a boat.

SUMMARY OF THE INVENTION

The present invention recognizes the various drawbacks of the heretofore known flake ice-making machines and provides straightforward solutions.

The present invention provides a flake ice-making apparatus of the class described, wherein the cylindrical refrigerant evaporator provides the shortest possible refrigerant flow path through the evaporator.

In addition, the present invention provides a flake ice-making machine having a cylindrical evaporator which is of a straightforward construction which makes the manufacture of the cylindrical evaporator more economical.

Even further, the present invention provides a flake ice-making apparatus having a cylindrical evaporator construction which is less prone to defects in the manufacturing process.

Still further, the present invention provides a flake ice-making machine having a water distributor device which is not adversely effected in operation by tilting of the ice-making machine.

More particularly, the present invention provides a flake ice-making machine comprising a cylindrical refrigerant evaporator housing having an inner cylindrical side wall and an outer cylindrical side wall concentrically receiving the inner cylindrical side wall defining a cylindrical refrigerant evaporator chamber therebetween, the cylindrical bore surface of the inner cylindrical side wall defining an ice-forming surface, refrigerant inlet means in refrigerant flow communication with the bottom end of the cylindrical evaporator chamber for introducing refrigerant into the bottom end of the evaporator chamber, refrigerant outlet means in refrigerant flow communication with the top end of the cylindrical evaporator chamber for removing refrigerant from the top end of the evaporator chamber, water flow means for introducing water to be frozen at the top end of the evaporator housing to flow downwardly in a thin sheet over the ice-forming cylindrical bore surface of the inner cylindrical side wall, an ice-scraping blade located at the ice-forming cylindrical bore surface of the inner cylindrical side wall to scrape the thin layer of ice therefrom and flake the ice as it is being scraped, and means for moving the ice-scraping blade in a circular motion over the ice-forming cylindrical bore surface of the inner cylindrical side wall.

BRIEF DESCRIPTION OF THE DRAWINGS

A better understanding of the present invention will be had upon reference to the following description in conjunction with the accompanying drawings in which like numerals refer to like parts throughout the views and wherein.

DETAILED DESCRIPTION OF THE PREFERRED EMBODIMENTS

Figure 1:
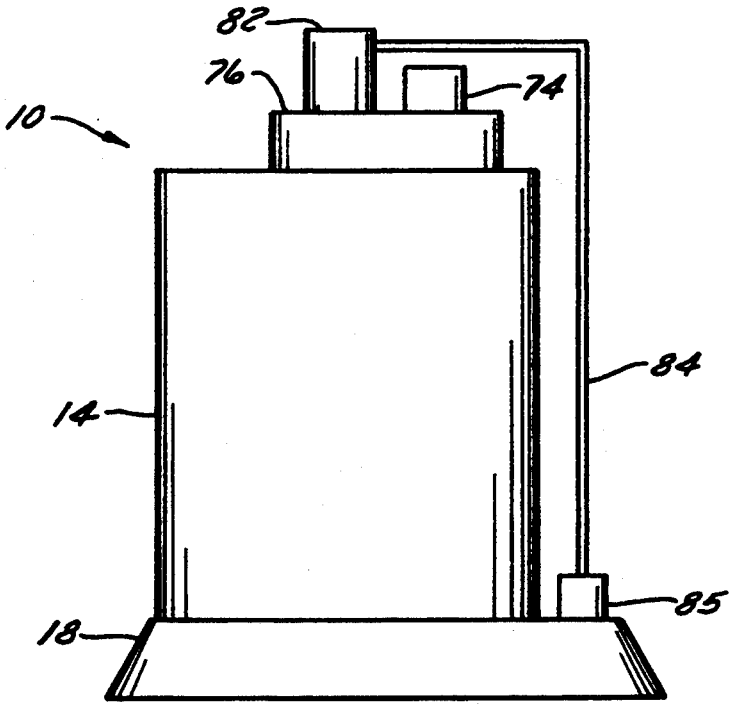
FIG. 1 is a side view of a flake ice-making machine of the present invention.
Figure 2:
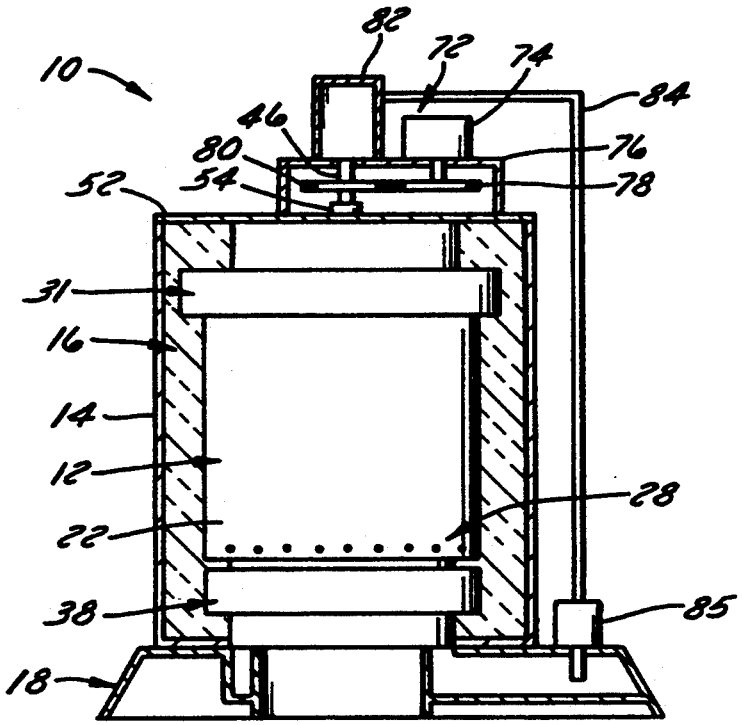
FIG. 2 is a cross-sectional side view of the flake ice-making machine of FIG. 1.

With reference to FIGS. 1 and 2, there is shown a flake ice-making apparatus, generally denoted by the numeral 10, of the present invention. The flake ice-making apparatus 10 includes a cylindrical refrigerant evaporator housing 12 surrounded by an outer jacket 14 spaced outwardly from the evaporator 12. The annular space between the evaporator 12 and jacket 14 is filled with a thermal insulation 16. The flake ice-making apparatus 10 is shown as being installed over and supported by a toroidally-shaped water reservoir 18.

Figure 3:
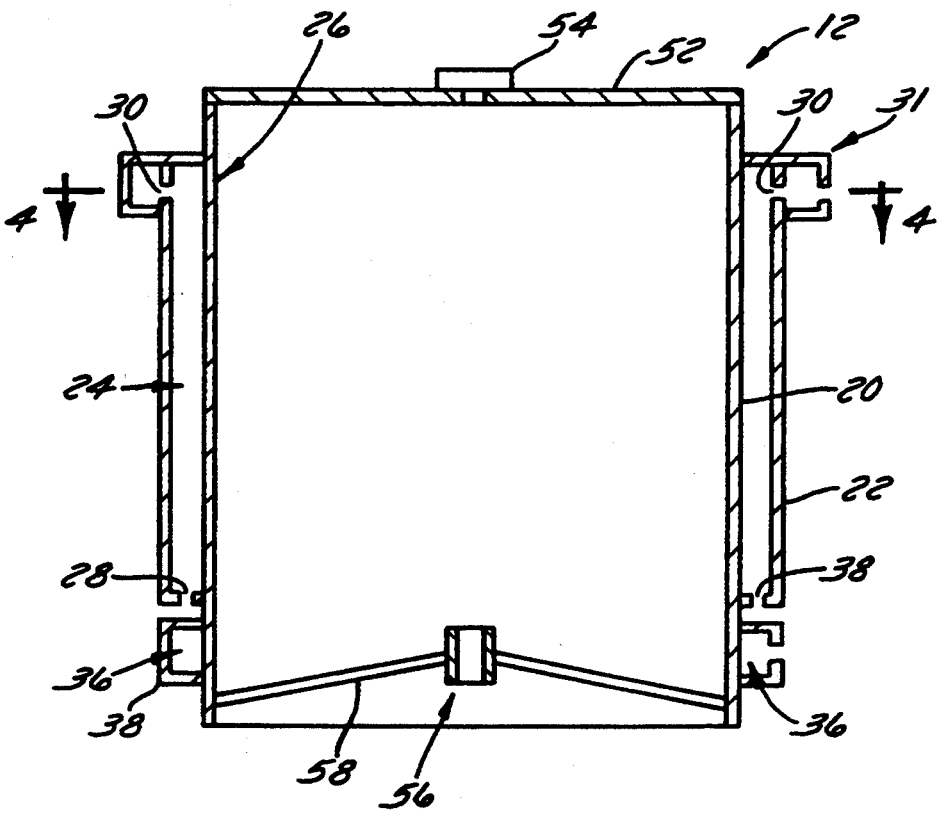
FIG. 3 is a cross-sectional side view of the cylindrical evaporator of the flake ice-making machine of FIGS. 1 and 2.
Figure 4:
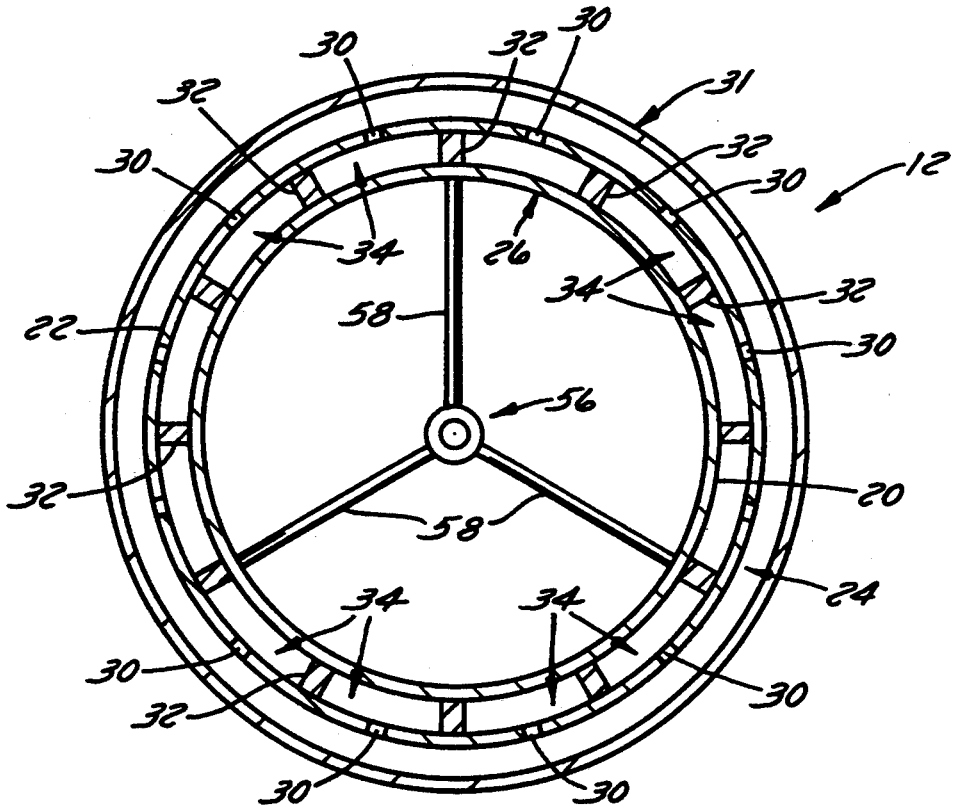
FIG. 4 is a cross-sectional top view of the cylindrical evaporator housing of FIG. 3.

With reference to FIGS. 2–4, the cylindrical refrigerant evaporator 12 comprises an inner cylindrical side wall 20 and an outer cylindrical side wall 22 concentrically receiving the inner cylindrical side wall 20 defining a cylindrical refrigerant evaporator chamber 24 therebetween. The lower end of the inner cylindrical side wall 20 extends below the lower end of the outer cylindrical side wall 22. The cylindrical bore surface 26 of the inner cylindrical side wall 20 defines an ice-forming surface of the refrigerant evaporator 12. The evaporator 12 further includes refrigerant inlet means, generally denoted as the numeral 28, in refrigerant flow communication with the bottom end of the cylindrical evaporator chamber 24 for introducing refrigerant into the bottom end of the evaporator chamber 24, and refrigerant outlet means, generally denoted as the numeral 30, in refrigerant flow communication with the top end of the cylindrical evaporator chamber 24 for removing refrigerant from the top end of the evaporator chamber 24. The refrigerant inlet means 28 is shown as a plurality of orifices formed through the outer cylindrical side wall 22 at spaced-apart intervals about the circumference of the outer cylindrical side wall 22 proximate the bottom end of the outer side wall 22. The refrigerant outlet means 30 is shown as a plurality of orifices formed through the outer cylindrical side wall 22 at spaced-apart intervals about the circumference of the outer cylindrical side wall 22 proximate the top end of the outer side wall 22. An annular refrigerant outlet header 31 circumferentially surrounds the evaporator chamber 24, and more particularly the outer side wall 22, and is in open refrigerant flow communication with all of the refrigerant outlet orifices 30 to collect the refrigerant leaving the evaporator chamber 24.

Figure 5:
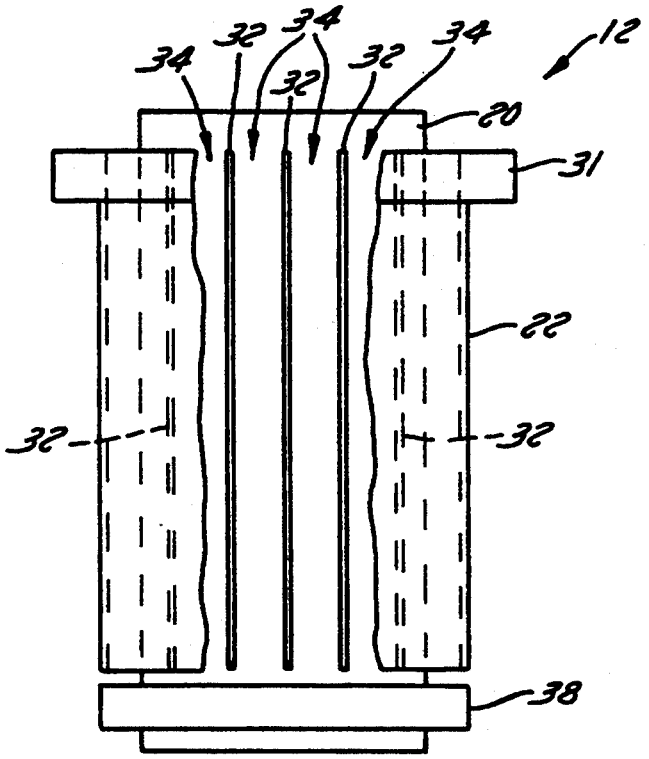
FIG. 5 is a side view of the cylindrical evaporator with portions broken away to show internal details.

With reference to FIGS. 4 and 5, the cylindrical refrigerant evaporator 12 further comprises partitions 32 in the cylindrical evaporator chamber 24 circumferentially dividing the evaporator chamber 24 into a plurality of parallel, vertical, straight refrigerant flow paths 34 extending from the bottom end of the evaporator chamber 24 to the top end of the evaporator chamber 24. The partitions 32 extends the width of the evaporator chamber 24 between the inner side wall 20 and outer side wall 22 and a length equal to the height of the evaporator chamber 24. The refrigerant inlet orifices 28 are open to the bottom ends of the flow paths 34, and the refrigerant outlet orifices. 30 are open to the top ends of the flow paths 34.

With reference to FIGS. 2, 3, and 5, the flake ice-making apparatus 10 also includes a means defining an annular warming chamber 36 located beneath the refrigerant evaporator chamber 24. The warming chamber defining means 36 comprises a collar 38 circumferentially surrounding the outside surface of the portion of the inner cylindrical side wall depending from the outer cylindrical side wall 22.

Figure 8:
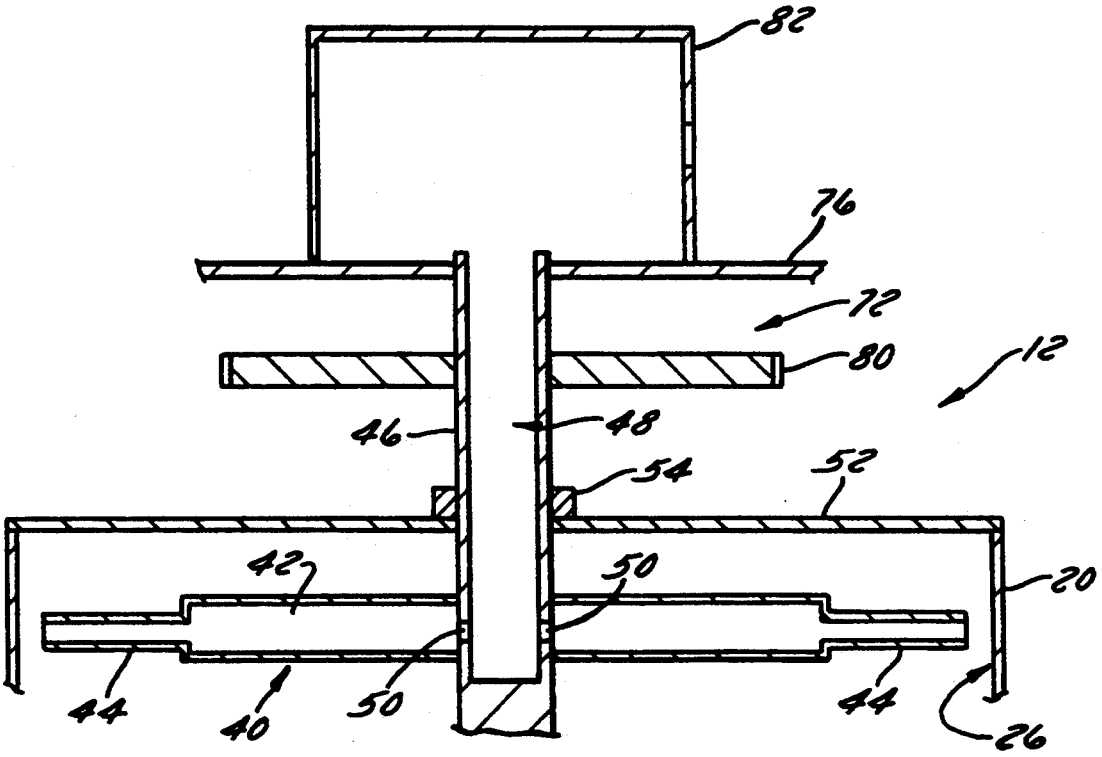
FIG. 8 is an enlarged cross-sectional side view of a portion of the present invention shown in FIG. 6.
Figure 6:
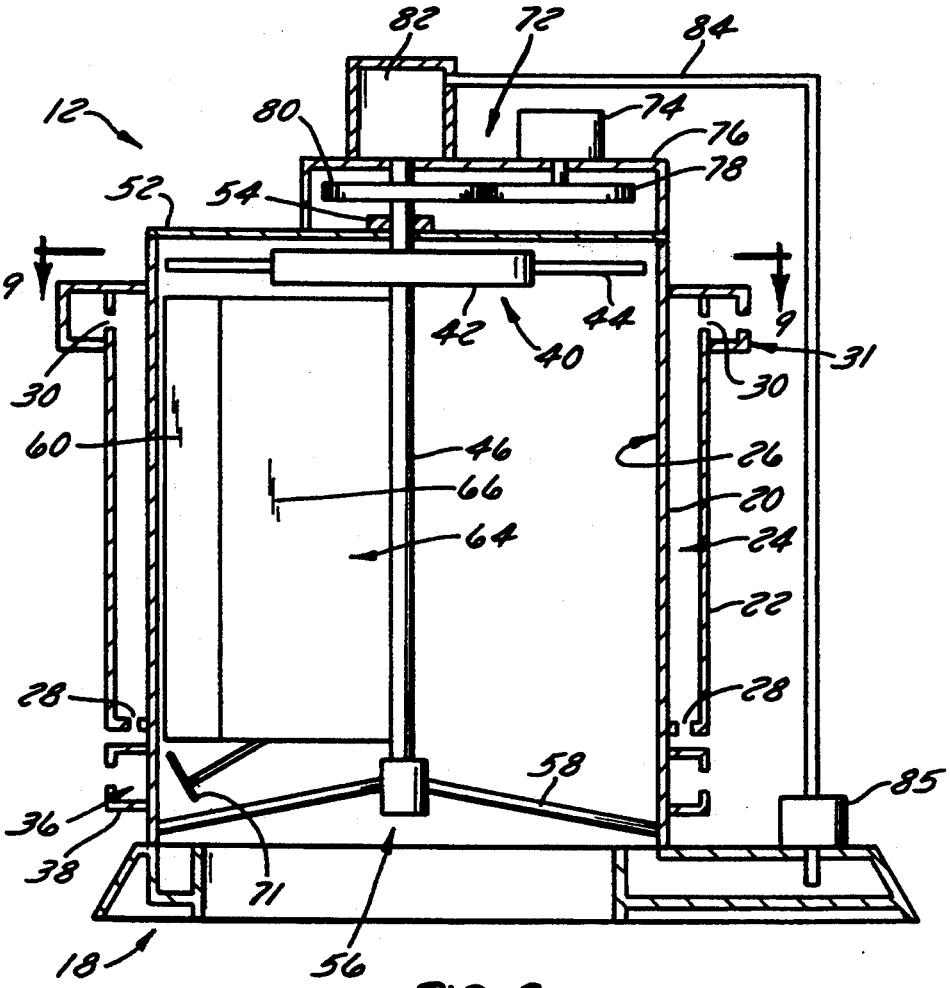
FIG. 6 is a cross-sectional side view of the cylindrical evaporator showing additional components of the invention.
Figure 10:
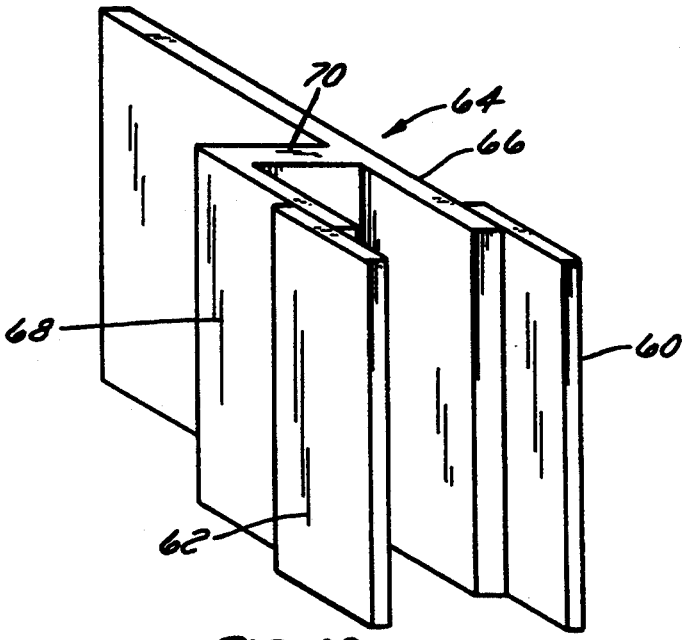
FIG. 10 is an enlarged perspective view of a component of the present invention; and, FIG. 11 is a schematic representation of the flake ice-making machine of the present invention and a refrigerant circuit.
Figure 7:
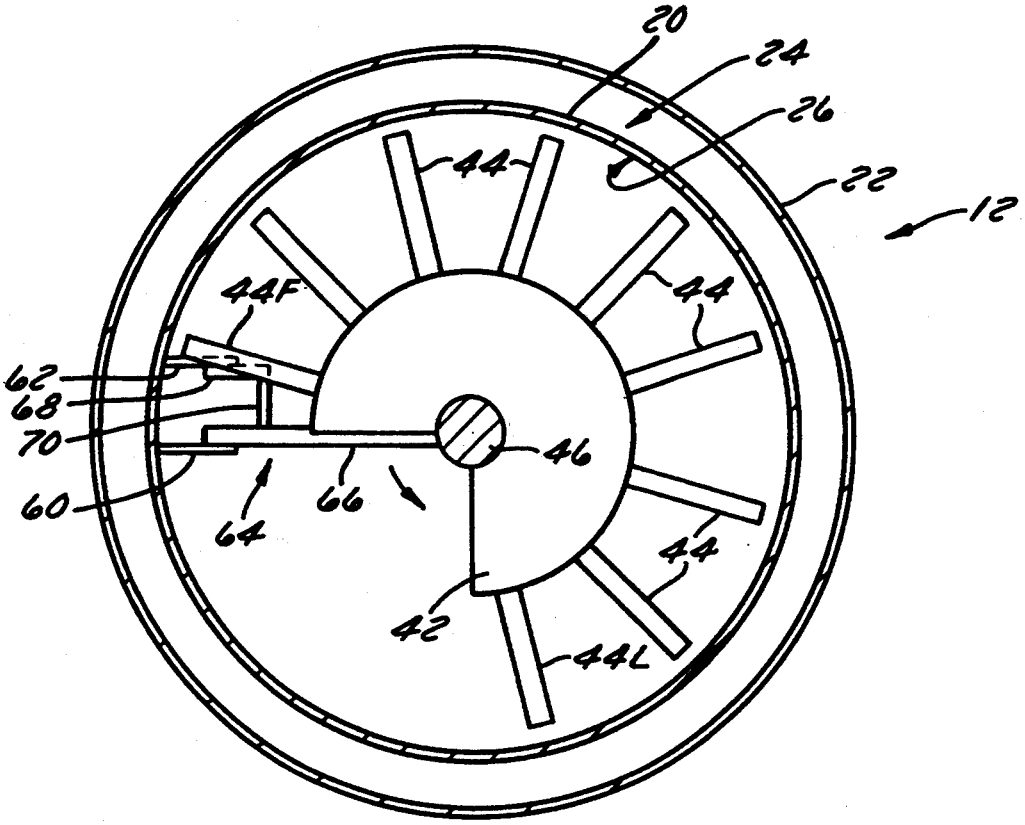
FIG. 7 is a top cross-sectional view as seen in the direction of arrows 7—7 in FIG. 6.

With reference to FIGS. 6, 7, and 8, the flake ice-making apparatus 10 also includes water flow distribution means, generally denoted as the numeral 40, for introducing water to be frozen at the top end of the cylindrical evaporator 12 so that the water flows downwardly in a thin sheet over the ice-forming cylindrical bore surface 26 of the inner cylindrical side wall 20. The water flow distribution means 40 is located at the top end of the evaporator 12 inside the inner cylindrical side wall 20 and generates an arcuate water spray pattern of less than 360 degrees in a horizontal plane, or plane perpendicular to the longitudinal central axis of the cylindrical evaporator 12. The water-flow distribution means 40 comprises a plenum 42 having a plurality of water jet nozzles 44 circumferentially spaced apart from each other about the plenum and radially directed outwardly from the plenum 42 in water-flow communication with the plenum 42. The nozzles 44 circumferentially extend through a circumferential arc of the plenum 42 of less than 360 degrees, for example, 270 degrees to generate the arcuate water spray pattern of 270 degrees. For example, the first nozzle 44F is spaced from the last nozzle 44L by an arc of 90 degrees. The nozzles 44 radially project outwardly of the plenum 42 by a dimension such that the outlet of the nozzles 44 are in close proximity to the cylindrical bore surface 26 of the inner cylindrical side wall 20. The water-flow distribution means 40 is mounted to a vertically driven shaft 46 concentric with the longitudinal central axis of the cylindrical evaporator 12. The driven shaft 46 extends essentially the entire height of the cylindrical evaporator 12 and is mounted to the cylindrical evaporator 12 for rotation therein. The plenum 42 is mounted to the top end portion of the driven shaft 46 for rotation therewith and with the nozzles 44 oriented to produce the arcuate water-spray pattern in a horizontal plane perpendicular to the longitudinal axis of the driven shaft 46. The nozzles 44 extend outwardly from the plenum 42 into close proximity to the cylindrical bore surface 26 of the inner cylindrical side wall 20. The top end portion of the driven shaft 46 is formed with a hollow water inlet bore 48 and at least one radial port 50 communicating with the water inlet bore 48 of the drive shaft 46 and communicating with the interior of the plenum 42 to provide flow water from the bore 48 to the plenum 42.

With continued reference to FIGS. 2, 3, 5, 6, and 8, a top plate 52 is mounted over and closes the top end of the cylindrical refrigerant evaporator 12. The top plate 52 is formed with a central aperture coaxial with the central axis of the cylindrical evaporator 12, and a driven shaft top support bearing 54 is mounted to the top plate 52 at the central aperture. A driven shaft bottom support bearing 56 is located at the bottom end of the cylindrical refrigerant evaporator 12 in coaxial alignment with the top support bearing 54 and is mounted to the inner cylindrical side wall 20 by a spider construction 58 so the bottom end of the inner cylindrical side wall 20 remains essentially open to define a flaked ice and drain water outlet from the cylindrical refrigerant evaporator 12.

With reference to FIGS. 6, 7, 9 and 10, the flake ice-making machine 10 also includes an elongated ice-scraping blade 60 parallel to the central axis of the cylindrical evaporator 12 and, therefore, parallel to the driven shaft 46. The ice-scraping blade 60 is mounted to the driven shaft 46 for rotation therewith and is located with the scraping edge in close proximity to the ice-forming cylindrical bore surface 26 of the inner cylindrical side wall 20. The ice-scraping blade 60 extends essentially the height of the cylindrical refrigerant evaporator chamber 24. In addition, an elongated blade 62 is parallel to the scraping blade 60, behind or to the rear of and spaced from the ice-scraping blade 60 relative to the direction of rotational movement of the ice-scraping blade 60. The wiper blade 62 is mounted to the driven shaft 46 for rotation therewith and is located with the wiping edge in contact with the ice-forming cylindrical bore surface 26 of the inner cylindrical side wall 20. The wiper blade 62 extends essentially the length of the scraping blade 60. As shown, the scraping blade 60 and wiper blade 62 are mounted to the driven shaft 46 by a blade mounting fixture 64. The blade-mounting fixture 64 includes a radially-projecting scraper blade mounting plate 66 parallel to the longitudinal axis of the driven shaft 46 and attached to the driven shaft 46 by, for example, a weldment, and a radially-projecting wiper blade mounting plate 68 generally parallel to and spaced from the scraper blade mounting plate 66 behind or to the rear of the scraper blade mounting plate 66 relative to the direction of rotational movement of the driven shaft 46. The wiper blade mounting plate 68 is shown as being attached to the scraper blade mounting plate 66 by a flange 70 perpendicular to and interconnecting the scraper blade mounting plate 66 and wiper blade mounting plate 68.

With reference to FIG. 7, the water-flow distribution means 40 is oriented relative to the ice-scraping blade 60 and the wiper blade 62 such that the first one of the nozzles 44F is located adjacent the wiper blade 62 to the rear of the wiper blade 62 relative to the direction of rotation of the wiper blade 62 (i.e., to the opposite side of the wiper blade 62 from the location of the ice-scraping blade 60) and such that the last one of the nozzles 44L is located in spaced relationship to the ice-scraping blade 60 to the front of the ice-scraping blade 60 relative to the direction of rotation of the ice-scraping blade 60 (i.e., to the opposite side of the ice-scraping blade 60 from the location of the wiper blade 62). In the example discussed above, wherein the water spray nozzles 44 extend through a circumferential arc of 270 degrees, such that the last one of the nozzles 44L is arcuately spaced in front of the ice-scraping blade 60 by about 90 degrees. This feature allows the water sprayed on the ice-forming bore surface 26 of the inner cylindrical side wall 22 to freeze into a thin sheet before the ice-scraping blade 60 reaches it.

Figure 9:
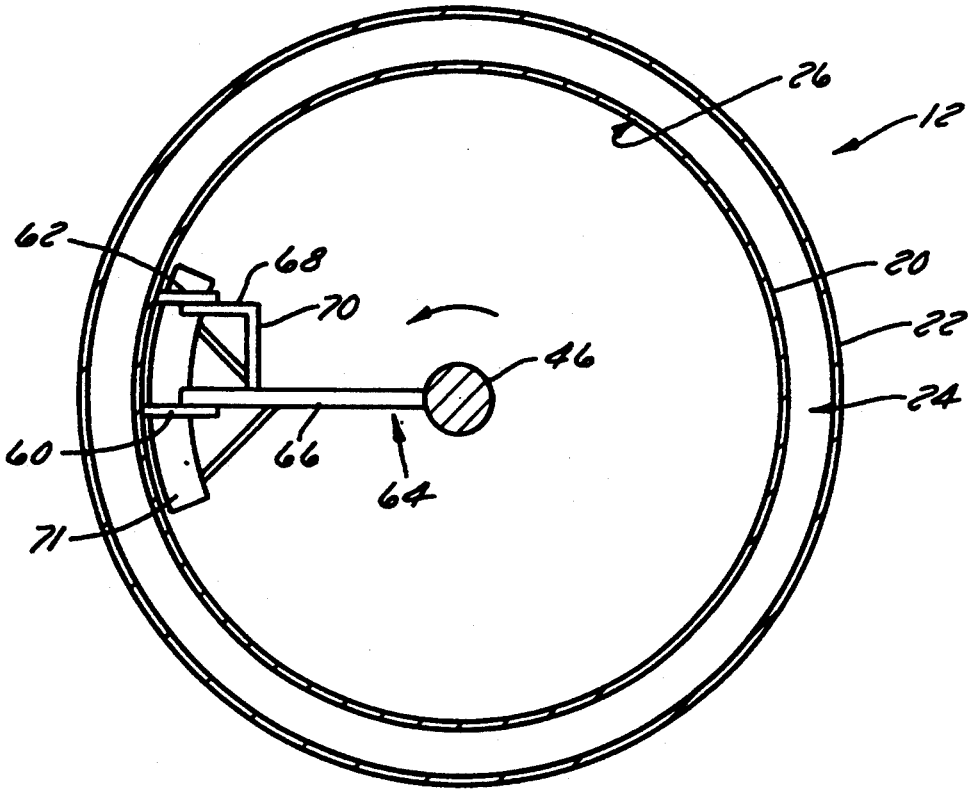
FIG. 9 is a top cross-sectional view as seen in the direction of arrows 9—9 in FIG. 6.

With reference to FIGS. 6 and 9, a flake ice deflector 71 is located generally beneath the bottom end of the scraper blade 60 for deflecting ice flaked from the cylindrical ice-forming bore surface 26 of the inner cylindrical side wall 20 by the scraping blade 60 in a generally inwardly direction of the inner cylindrical side wall 20 so that the flaked ice will fall downwardly out of the open bottom end of the inner cylindrical side wall 20 out of the flake ice-making machine 10 and downwardly through the open center of the toroidal water reservoir 18. The ice deflector 71 is formed of an arcuate and slanted plate having an outside radius substantially equal to the radius of the inner cylindrical side wall 20. The arcuate plate 71 is secured to the scraper blade mounting plate 66 below the scraper blade 60 such that the outside arcuate edge of the arcuate plate 71 is adjacent the ice-forming bore surface 26 of the inner cylindrical side wall 20 and so that the plate 71 slants downwardly from the ice-forming bore surface 26 of the inner cylindrical side wall 20 toward the center of the inner cylindrical side wall 20.

As shown in FIGS. 2 and 6, the flake ice-making apparatus 10 further includes driven shaft drive means, generally denoted as the numeral 72 for driving the driven shaft 46 about its longitudinal axis and, thereby, rotating the water flow distribution means 40, the scraping blade 60 and the wiping blade 62 inside the inner cylindrical side wall 20. As shown, the driven shaft drive means 72 comprises a motor 74, such as an electric motor, a hydraulic motor, and the like, mounted to the top end of the evaporator 12 on a mounting plate 76 attached to and over the top plate 52 with the output shaft of the motor 74 depending in parallel relationship to the driven shaft 46. A driving gear 78 is mounted to the output shaft of the motor 74 and a driven gear 80 is mounted on the vertical driven shaft 46, above the top plate 52, in meshing engagement with the driving gear 78.

As shown in FIGS. 1, 2, 6, and 8, the flake ice-making machine 10 further includes a water box 82 located on plate 76 at the top end of the vertical driven shaft 46 and in water-flow communication with the hollow top end portion 48 of the driven shaft 46. The water box 82 is in water communication with a source of water, such as the water reservoir 18, by means of a water conduit 84. An appropriate water pump 85 for pumping water from the reservoir 18 through the water conduit 84 to the water-flow distribution means 40. The water pump 85 can be, for example an electric pump, a hydraulically-operated pump, and the like.

Figure 11:
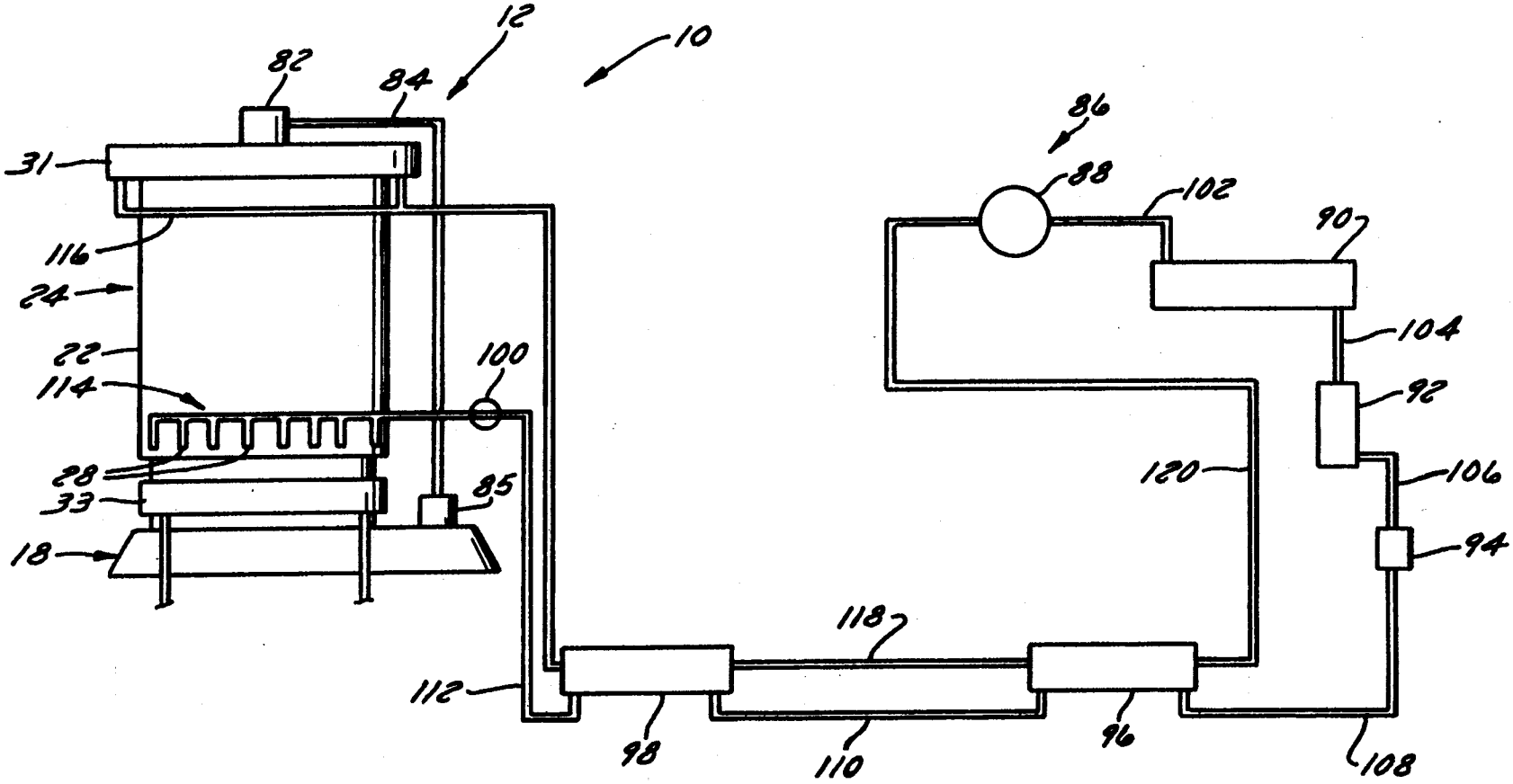

Now with reference to FIG. 11, there is shown a typical refrigerant circuit, generally denoted as the numeral 86. The refrigerant circuit 86 includes, for example, a compressor 88, a condenser 90, a filter 92, a receiver 94, a first heat exchanger 96, a second heat exchanger 98, and an expansion valve 100. The high pressure side of the compressor 88 is in refrigerant flow communication with the inlet of the condenser 90 by supply conduit 102, the outlet of the condenser 90 is in refrigerant flow communication with the inlet to the filter 92 by supply conduit 104, the outlet of the filter 92 is in refrigerant flow communication with the inlet of the receiver 94 by supply conduit 106, the outlet of the receiver 94 is in refrigerant flow communication with the inlet of the first heat exchanger 96 by supply conduit 108, the outlet of the first heat exchanger 96 is in refrigerant flow communication with the inlet of the second heat exchange 98 by supply conduit 110, and the outlet of the second heat exchanger 98 is in refrigerant flow communication with the inlet of the expansion valve 100 by supply conduit 112. The refrigerant circuit 86 further includes a refrigerant inlet manifold 114 in refrigerant flow communication with each of the refrigerant inlet apertures 28 of the cylindrical evaporator chamber 24 and with the outlet of the expansion valve 100. The refrigerant inlet manifold 114 evenly distributes refrigerant received from the expansion valve 100 into the bottom end of each of the refrigerant flow paths 34 of the evaporator chamber 24. The refrigerant outlet header 31 has an outlet port in refrigerant flow communication with a second inlet of the second heat exchanger 98 by return conduit 116. A second outlet of the second heat exchanger 98 is in refrigerant flow communication with a second inlet of the first heat exchanger 96 by return conduit 118, and a second outlet of the first heat exchanger 96 is in refrigerant flow communication with the low-pressure side of the compressor 88 by return conduit 120.

The annular warming chamber 36 is in fluid-flow communication with a source of warm liquid, such as for example a source of warm water or warm refrigerant. In an application on a fishing boat or the like having hydraulically-operated equipment, the motor 74 of the driven shaft drive means 72 and the water pump 85 can advantageously be hydraulically operated. In this application, the annular warming chamber 36 is advantageously in hydraulic fluid-flow communication with a hydraulic circuit. The warm fluid, for example warm hydraulic fluid, circulating through the warming chamber 36 will prevent ice from forming on the lower portion of the cylindrical bore surface 26 of the inner cylindrical side wall 20 beneath the evaporator chamber 24, or on the spider construction 58. A side benefit of this arrangement is that the hydraulic fluid flowing through the warming chamber 36 is cooled before it is returned to the hydraulically-operated equipment.

In operation of the flake ice-making apparatus 10, the water from the water-flow distribution means 40 is discharged under pressure against the ice-forming bore surface 26 of the inner cylindrical side wall 20 at the top end of the inner cylindrical side wall 20. This feature provides for uniform water distribution against the ice-forming bore surface 26, regardless of the tilt of the flake ice-making machine 10 as will occur in applications, wherein the flake ice-making machine is installed on a boat. As the water flows downwardly over the ice-forming bore surface 26, it is frozen into a thin layer on the bore surface 26 by the refrigerant flowing upwardly in the evaporator chamber 24. Concurrently, the rotating ice-scraping blade 60 is moved over the bore surface 26 of the inner cylindrical side wall 20 scraping the thin layer of ice from the ice-forming bore surface 26 and also breaking the ice into flakes. The wiper blade 62 follows the scraping blade 60 over the bore surface 26 cleaning any residual ice from the bore surface 26. The flaked ice formed by the scraping blade 60 is captured in the space between the parallel scraping blade 60 and wiper blade 62 and falls downwardly by gravity to the flaked ice deflector plate 71 beneath the scraping blade 60. The deflector plate 71 deflects the falling ice flakes toward the center of the inner cylindrical side wall 20 so that the flaked ice will fall out of the flake ice-making machine 10 through the open bottom of the inner cylindrical side wall 20 and through the opening of the toroidal water reservoir 18. If ice were allowed to be formed on the bore surface 26 of the inner cylindrical side wall 20 beneath the ice-scraper blade 60, it could interfere with the operation of the ice-making operation by, for example, interfering with the discharge of the flaked ice from the inner cylindrical side wall. This potential problem is solved by the provision of the annular warming chamber 36. The warm liquid flowing through the warming chamber 36 prevents any ice from forming on the bore surface 26 beneath the ice-scraping blade. The water flows downwardly out of the open bottom the inner cylindrical side wall 20 and into the toroidal water reservoir 18.

The foregoing detailed description is given primarily for clearness of understanding and no unnecessary limitations are to be understood therefrom for modifications will become obvious to those skilled in the art upon reading this disclosure and may be made without departing from the scope of the inventions or scope of the appended claims.

What is claimed is:

1. A flake ice-making machine, comprising:

a. a cylindrical refrigerant evaporator having an inner cylindrical side wall and an outer cylindrical side wall concentrically receiving the inner cylindrical side wall defining a cylindrical refrigerant evaporator chamber therebetween, and the cylindrical bore surface of the inner cylindrical side wall defining an ice-forming surface;

b. refrigerant inlet means in fluid-flow communication with the bottom end of the cylindrical evaporator chamber for introducing refrigerant into the bottom end of the cylindrical evaporator chamber;

c. refrigerant outlet means in fluid-flow communication with the top end of the cylindrical evaporator chamber for removing refrigerant from the top end of the cylindrical evaporator chamber;

d. water-flow distribution means for introducing water to be frozen against the cylindrical bore surface of the inner cylindrical side wall at the top end of the inner cylindrical side wall to flow downwardly in a thin sheet over the cylindrical bore surface;

e. an elongated ice-scraping blade located at the cylindrical bore surface of the inner cylindrical side wall;

f. means for moving the ice-scraping blade in a rotary motion over the cylindrical bore surface of the inner cylindrical side wall;

g. warming means for preventing the formation of ice on the ice-forming cylindrical bore surface of the inner cylindrical side wall beneath the cylindrical refrigerant evaporator chamber.

2. The flake ice-making machine of claim 1, and further comprising vertical partitions extending between said inner cylindrical side wall and said outer cylindrical side wall so as to divide the cylindrical evaporator chamber into a plurality of parallel, vertical, straight refrigerant flow paths extending from the bottom end of the cylindrical evaporator chamber to the top end of the cylindrical evaporator chamber.

3. The flake ice-making machine of claim 2, further comprising a refrigerant outlet header located at the top end of the cylindrical evaporator chamber and in refrigerant flow communication with the plurality of flow paths to collect refrigerant leaving the evaporator chamber.

4. The flake ice-making machine of claim 3, wherein the refrigerant outlet header circumferentially surrounds the evaporator chamber.

5. The flake ice-making machine of claim 2, wherein the refrigerant inlet means further comprises a refrigerant flow inlet manifold in refrigerant flow communication with each of the refrigerant flow paths of the evaporator chamber.

6. The flake ice-making machine of claim 1, wherein the warming means comprises:

a. means defining a warming chamber located beneath the refrigerant evaporator chamber and surrounding the inner cylindrical side wall; and, b. means for introducing an warming fluid into the warming chamber.

7. A flake ice-making machine, comprising:

a. a cylindrical refrigerant evaporator having an inner cylindrical side wall and an outer cylindrical side wall concentrically receiving the inner cylindrical side wall defining a cylindrical refrigerant evaporator chamber therebetween, and the cylindrical bore surface of the inner cylindrical side wall defining an ice-forming surface;

b. refrigerant inlet means in fluid-flow communication with the bottom end of the cylindrical evaporator chamber for introducing refrigerant into the bottom end of the cylindrical evaporator chamber;

c. refrigerant outlet means in fluid-flow communication with the top end of the cylindrical evaporator chamber for removing refrigerant from the top end of the cylindrical evaporator chamber;

d. water-flow distribution means for introducing water to be frozen against the cylindrical bore surface of the inner cylindrical side wall at the top end of the inner cylindrical side wall to flow downwardly in a thin sheet over the cylindrical bore surface;

e. an elongated ice-scraping blade located at the cylindrical bore surface of the inner cylindrical side wall;

f. means for moving the ice-scraping blade in a rotary motion over the cylindrical bore surface of the inner cylindrical side wall;

g. an elongated wiper blade located at the cylindrical bore surface of the inner cylindrical side wall behind the ice-scraping blade relative to the direction of circular motion of the ice-scraping blade; and, h. means for moving the wiper blade in a rotary motion over the cylindrical bore surface of the inner cylindrical side wall in coordination with the rotary motion of the ice-scraping blade and behind the ice-scraping blade.

8. The flake ice-making machine of claim 7, further comprising:

a. a flake ice deflector located beneath the ice-flaking blade; and b. means for moving the flake ice deflector in a rotary motion in coordination with the rotary motion of the ice-scraping blade.

9. The flake-ice making machine of claim 7, wherein the wiper blade and the ice-scraping blade cooperate to define a flaked-ice capturing space therebetween.

10. In a flake ice-making machine, comprising:

a cylindrical refrigerant evaporator including an inner cylindrical side wall in heat transfer communication with an evaporator chamber; a water distributor for introducing water to be frozen against the inner surface of said inner cylindrical side wall at the top end of the inner cylindrical side wall to flow downwardly in a thin sheet over the cylindrical bore surface; an elongated ice-scraping blade located at the inner surface of said inner cylindrical side wall; and a drive for moving the ice-scraping blade in a rotary motion over the inner surface of said inner cylindrical side wall; the improvement comprising:

an enclosed water plenum at the top of said cylindrical refrigerant evaporator;

a plurality of water jet nozzles circumferentially spaced apart from each other about the plenum and radially directed outwardly from the plenum toward the cylindrical bore surface of the inner cylindrical side wall for generating an arcuate water distribution patter of less than 360 degrees; and a pump for creating a pressure in the plenum.

11. The flake ice-making machine of claim 10, further comprising a water reservoir located beneath the cylindrical refrigerant evaporator for collecting water draining from the evaporator.

12. In a flake ice making machine, comprising:

a cylindrical refrigerant evaporator including an inner cylindrical side wall and a concentric outer cylindrical side wall, with a space between said inner and outer cylindrical side walls, said space defining a refrigerant evaporator chamber;

a refrigerant inlet and a refrigerant outlet in fluid flow communication with said refrigerant evaporator chamber;

a water distributor for introducing water to be frozen against the inner surface of said inner cylindrical side wall at the top end of the inner cylindrical side wall to flow downwardly in a thin sheet over said inner surface;

an elongated ice-scraping blade located at the inner surface of said inner cylindrical side wall; and a drive for moving the ice-scraping blade in a rotary motion over the inner surface of said inner cylindrical side wall; the improvement comprising:

said inner cylindrical side wall extending downwardly, below the bottom of said refrigerant evaporator chamber; and a warming chamber lying outside the portion of said inner cylindrical side wall which extends below the bottom of said refrigerant evaporator chamber so as to prevent the formation of ice on the inner surface of said inner cylindrical side wall below said refrigerant evaporator chamber.

* * * * *